United States Patent [19]

Wayte

[11] Patent Number: 4,893,941

[45] Date of Patent: Jan. 16, 1990

[54] APPARATUS FOR MIXING VISCOUS LIQUID IN A CONTAINER

[76] Inventor: Joseph M. Wayte, 14301 Greenbelt Drive E, Sumner, Wash. 98392

[21] Appl. No.: 213,078

[22] Filed: Jun. 29, 1988

Related U.S. Application Data

[63] Continuation-in-part of Ser. No. 69,813, Jul. 6, 1987, abandoned.

[51] Int. Cl.[4] ..... B01F 5/12

[52] U.S. Cl. ..... 366/265; 366/317; 366/343

[58] Field of Search ..... 366/65, 98, 155, 182, 366/194, 244–249, 262–265, 279, 315–317, 342, 343, 605, 270; 416/182, 184, 185, 186 R, 186 A; 415/DIG. 3

[56] References Cited

U.S. PATENT DOCUMENTS

| | | | |
|---|---|---|---|
| 1,084,210 | 1/1914 | Howard | 366/194 X |
| 1,767,227 | 6/1930 | Remick | 366/270 |
| 2,230,146 | 1/1941 | Myers | 366/317 X |
| 2,787,447 | 4/1957 | Crawford | 366/182 X |
| 3,147,957 | 9/1964 | Martin | 366/263 |
| 3,290,016 | 12/1966 | Lennon | 366/317 |
| 3,690,621 | 9/1972 | Tanaka et al. | 366/265 |
| 3,999,889 | 12/1976 | Caulk et al. | 366/343 X |
| 4,248,571 | 2/1981 | Sieghartner | 415/DIG. 3 |
| 4,378,165 | 3/1983 | Landberg | 366/270 |
| 4,451,155 | 5/1984 | Weber et al. | 366/317 X |
| 4,529,321 | 7/1985 | Berchoux | 366/317 X |
| 4,534,657 | 8/1985 | Clement | 366/317 X |

FOREIGN PATENT DOCUMENTS

| | | | |
|---|---|---|---|
| 207767 | 5/1957 | Australia | 366/315 |

*Primary Examiner*—Philip R. Coe
*Assistant Examiner*—Stephen F. Gerrity
*Attorney, Agent, or Firm*—Dowrey, Cross & cole

[57] ABSTRACT

A rotary device for mixing viscous liquids within a container. A vertical rotary driven shaft is connected to a circular disc at its terminal end. Radial or tangential mixing vanes are connected to the top surface of the disc and a baffle plate or cover disc is located over the vanes to prevent vertical flow in the area of the vanes. A central flow passage is provided about the shaft. Fluid is driven laterally outwardly by the vanes and replacement fluid is pulled downwardly by a pumping action along the shaft and likewise driven laterally outwardly for mixing. A removable washer shaped flow restrictor is placed in the central flow passage, vertically supported by the inner ends of the vanes and held in place by the downward flow during rotation of the mixing device.

14 Claims, 2 Drawing Sheets

APPARATUS FOR MIXING VISCOUS LIQUID IN A CONTAINER

BACKGROUND OF THE INVENTION

1. Field Of The Invention

This is a continuation-in-part of my prior application Ser. No. 069,813, filed July 6, 1987, now abandoned.

This invention relates to rotary devices for mixing viscous liquid within a container, more particularly the invention relates to such mixing wherein obtaining highly homogenous consistencies is important as for instance with paint products and the like. The present apparatus is not, however, limited to the mixing of any particular viscous liquid and may be utilized in the mixing of liquids within a wide range of viscosities. Although the present disclosure discusses applications such as mixing of paints and asphaltic compositions such as roofing materials, such disclosure is intended to be by way of illustration and not limitation. The apparatus of the present invention is adaptable for home or shop use as well as for most commercial uses and may be designed for either stationary mounting or mounting in a conventional hand held drive motor unit such as a variable speed electric drill. The device may also be adapted, without structural modification, to effectively operate with liquids of different viscosities.

2. Description Of The Prior Art

Commercially available prior art devices for mixing such fluids as paints and the like within plastic or metal containers have suffered from a number of inadequacies. This has been especially true with respect to power driven mixing devices which, although producing adequate agitation; run the risk of damaging the container if not properly handled. Those devices which do not depend upon extreme agitation, tend to be inefficient in the mixing function in terms of the time required for mixing and the degree of mixing. Prior art devices oftimes are also unable to affect highly settled or semi-solidified material in certain areas of the container, as for instance the inside bottom periphery of a paint can. In addition, mixing devices are usually limited in effectiveness when used with a wide range of viscosities. For instance, a mixing device designed for use with a low viscosity substance such as paint would not be suitable for mixing highly viscous fluids such as asphalt or tar roofing substances.

The primary problems with prior art devices are therefore; inefficiencies in the mixing operation within a container, the time consuming nature of the operation, inability to mix certain areas of containers to any degree, and the destructive nature of certain types of devices with respect to the container surfaces. The range of viscosities to which prior art liquid mixers can be adapted may also be limited.

SUMMARY OF THE INVENTION

The present invention provides an apparatus which produces an extremely efficient mixing flow in a controlled fashion, especially adapted for use within containers. The mixing device produces a positive multidirectional controlled flow which is enhanced even further by interaction with the container walls. Thus a positive mixing rather than simple agitation is accomplished with superior results regardless of the viscosity of the liquid being treated. Because of the circular configuration of the mixer element and protection of the mixing vanes, the power driven rotary element may be placed on or near the bottom of a cylindrical can. The mixing element may be moved about the inner periphery of the can to absolutely clear all unmixed concentrations. This action takes place with no danger of destruction to the container bottom or side walls. Because of the baffling effect of a top circular cover the liquid is positively pulled upwardly or downwardly through the center portion of the rotating mixer element and then driven with great force radially or tangentially outwardly at right angles. In certain embodiments of the invention the action of the top baffle plate is accomplished by curved or angled portions of the mixing vanes themselves. The force of the liquid driven by the rotating vanes along with the ability to move the mixing element in circular motion about the inner periphery of the can insures that all thickened or settled areas of the liquid will be dislodged and thoroughly mixed. In order to reach all areas of the container the mixing element may also be moved up and down within the container which also serves to prevent or counteract any vortexing during mixing. The rate of flow desired for different viscosities of fluids may be controlled by controlling the open access area in the top baffle plate without structural modification of the mixing element simply by adding or removing washer like baffles to the top baffle plate. The mixing element is carried on a central rotatable shaft which may be made adaptable for use with any variable speed motor such as a common electric drill. In order to adapt the apparatus to different size containers or to increase the mixing efficiency and decrease the mixing time, multiple mixing elements may be mounted on a single drive shaft.

DESCRIPTION OF THE PREFERRED EMBODIMENTS

Figure 1:
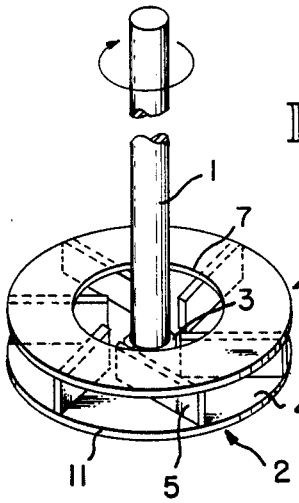
FIG. 1 is an isometric view of a preferred embodiment of the mixing element and the drive shaft therefore.

FIG. 1 illustrates a preferred embodiment of the mixing device wherein the mixing element is fixedly mounted on the end of a rotatable drive shaft 1 which may be driven by a hand held electric drive motor (not shown). A flat circular bottom plate 2 may be provided with a central hub 3 designed to receive the end of the drive shaft 1. The drive shaft 1 may be conveniently screw threaded into the central opening of the hub 3 or, if desired, may be otherwise directly connected to the top face 4 of the bottom plate. As illustrated in FIG. 1 the bottom plate 4 may comprise a flat disc and may be constructed from either sheet metal or a durable plastic if desired. A plurality of mixing vanes 5 are connected to the upper face 4 of the plate 2 and arranged uniformly about the circumference of the bottom plate. The vanes 5 are disposed in an upright position at right angles to the bottom plate 2 and extend from the outer periphery of the plate inwardly to a position adjacent the hub 3. As shown in FIG. 1, the vanes 5 extend tangentially to a circle which is concentric to the rotating shaft 1.

A top baffle ring or plate 6 is mounted on the top edges of the vanes 5 and may be in the form of a flat ring having the same outside diameter as the bottom plate 2. The plate 6 has a central opening 7 which provides a passage about the base of the shaft 1 for the flow of liquid during mixing as will be presently described. The ring 6 may be made of the same material as the bottom plate and vanes and the entire structure may be welded or otherwise rigidly connected to form the mixing element.

Figure 5:
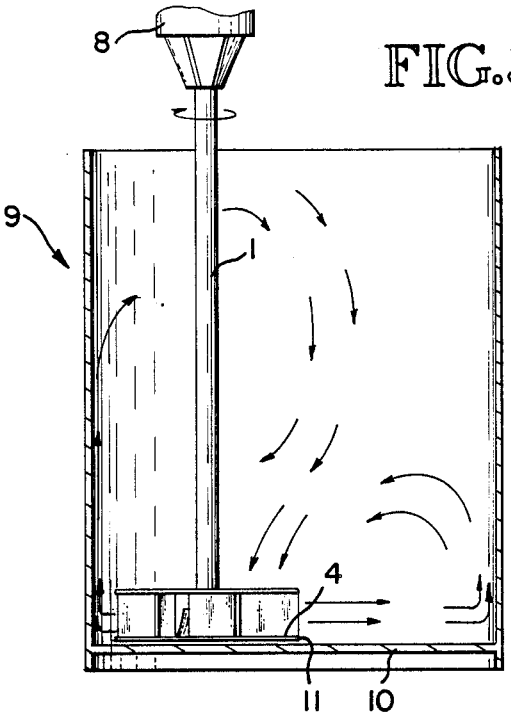
FIG. 5 is a schematic illustration of the operation of a mixing element of either the FIGS. 1 or 2 embodiment with the arrows indicating the flow pattern of fluid during the mixing action.

FIG. 5 is a schematic illustration of the operation of the mixing element driven by a hand held motor 8, such as an electric drill motor. The mixing element is shown in operation within a can 9 of viscous liquid such as paint or other liquid substance to be mixed. With the vane arrangement shown in FIG. 1 for instance, the shaft 1 will be rotated in the clockwise direction as viewed from the top, illustrated by the directional arrow in FIG. 1. During rotation, liquid within the container 9 is thrown outwardly horizontally in a tangential direction by the vanes 5. Simultaneously, liquid is drawn downwardly about the shaft 1 and through the opening 7 in the baffle plate 6 so as to produce a circular flow pattern about the entire circumference of the mixing element. This action is illustrated by the directional arrows in FIG. 5. The circular pattern results since the top baffle plate or ring 6 prevents the liquid from rising upwardly in the area above the vanes, requiring the liquid to follow a horizontal path when impelled by the vanes 5. As the liquid is forced laterally, of course, replacement fluid is drawn downwardly by pumping action about the shaft 1 and likewise impelled laterally. Because of the action of the baffle with respect to each vane, as the shaft is rotated, the liquid is actually impelled laterally with great force so as to positively circulate and mix even the most thickened portions of the liquid. The size of the opening 7 may be varied depending upon the viscosity of the liquid and/or mixing rate desired. Likewise, the vertical height of the vanes 5 may be varied in order to promote or restrict flow.

As illustrated in FIG. 5, the bottom plate 4 may be allowed to operate closely adjacent to or even rest on the bottom wall 10 of the container without damage thereto during rotation. The outer edge 11 of the plate 4 may be moved in a circular path around the periphery of the container bottom to positively dislodge and circulate any sediment or thickened portions of the liquid. As seen in FIG. 5, the proximity of the mixing element to the can side and bottom walls along with the force of the moving liquid creates extreme turbulence and mixing. In most cases it is possible to obtain one hundred percent mixing of the fluid in a very short time regardless of the condition of the liquid. The mixing element is, of course, moved upwardly and downwardly in the can to reach all areas of the body of liquid. This is especially effective in the case of deep containers and heavy liquid substances. This reciprocating or pumping action also prevents any tendency to create a vortex in the moving fluid.

Figure 6:
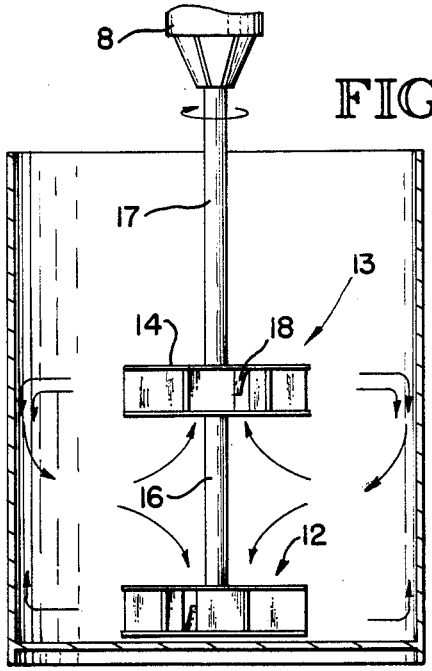
FIG. 6 is a schematic illustration of the flow pattern during mixing with the use of multiple mixing elements on a single rotating shaft.

FIG. 6 illustrates an arrangement of multiple mixing elements on a single vertical drive shaft. The shaft is provided with a first mixing element indicated generally at 12 on its bottom end in the manner described relative to FIG. 5, producing a first circular flow pattern in the container bottom as illustrated by the directional arrows. A second mixing element, cally spaced above the mixing element 12. This spacing may, of course, be varied depending on the desired results. In the arrangement shown in FIG. 6, the element 13 may be inverted from the element 12, i.e. with its solid disc plate 14 located on top, such that a reversed circular flow pattern, illustrated by the arrows, is produced from that of the bottom element 12. Needless to say the mixing efficiency is tremendously increased and, depending upon the size of the container and the viscosity of the liquid to be mixed, additional mixing elements may be located on the shaft if desired. As shown in FIG. 6, the drive shaft may be in two parts, the lower shaft section 16 and the upper shaft section 17, both of which may be screw threaded into the hub 18 of the top mixing element 13. In the alternative, a single rotatable drive shaft may be utilized with the plurality of mixing elements rigidly connected and vertically spaced therealong in any well known manner. With the arrangement shown in FIG. 6, the vertical reciprocating or pumping action of the mixing element is important since the greatest turbulence is created in the area between the mixing elements 12 and 13. This action is also important in this embodiment to prevent vortexing.

Figure 2:
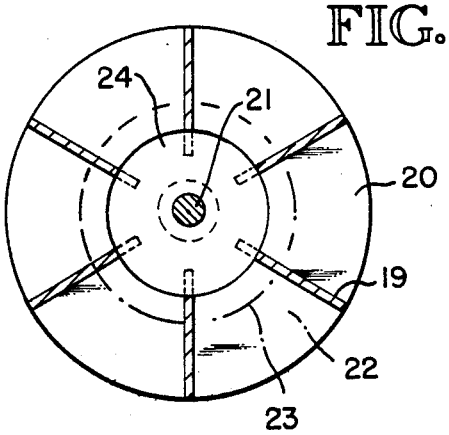
FIG. 2 is a plan view of a second embodiment of the mixing element utilizing radial mixing vanes with the top baffle plate removed.
Figure 7:
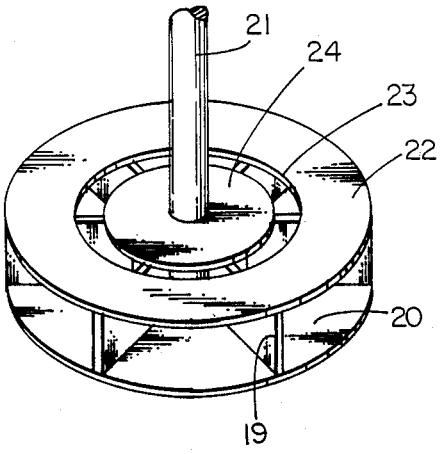
FIG. 7 is an isometric view of the missing element of FIG. 2 including a flow restrictor and the top baffle plate in place.

FIGS. 2 and 7 illustrate a second embodiment of the invention wherein the mixing vanes 19 extend vertically from the bottom disc 20 and radially outwardly from the central drive shaft 21. The bottom plate or disc 20 may be identical to the disc 4 as described for FIG. 1. The mixing vanes as viewed in plan in FIG. 2 are evenly spaced about the circumference of the bottom disc 20 and extend to a position closely adjacent the shaft 21. The top baffle ring or plate 22 is shown in phantom in FIG. 2 with the inner ends of the vanes 19 extending inwardly beyond the edge 23 of the baffle ring. The operation of the embodiment shown in FIG. 2 is identical to that shown in FIG. 1 insofar as the mixing flow pattern produced. FIGS. 2 and 7 also illustrate a means for varying the cross sectional flow area about the central shaft 21 and through the opening in the top baffle plate defined by the edge 23. A washer shaped disc or flow restrictor 24 having its central opening sized so as to pass easily over the central shaft 21, may be placed on top of the inner ends of the vanes 19. The diameter of the washer element 24 may be chosen such that the distance between the outer periphery of the washer 24 and the opening 23 provides a predetermined cross sectional area of liquid flow, depending upon the viscosity of the liquid to be mixed and/or the mixing rate desired. During the mixing action, of course, the downward flow of the liquid impinging against the washer 24 will hold it in place on top of the inner ends of the vanes 20. In this manner a single mixing element may be adapted for performing the desired mixing action on a wider range of viscosities. It will also be understood that the flow restrictor shown in the FIG. 2 embodiment of the mixing element may also be used in the FIG. 1 embodiment.

Figure 8:
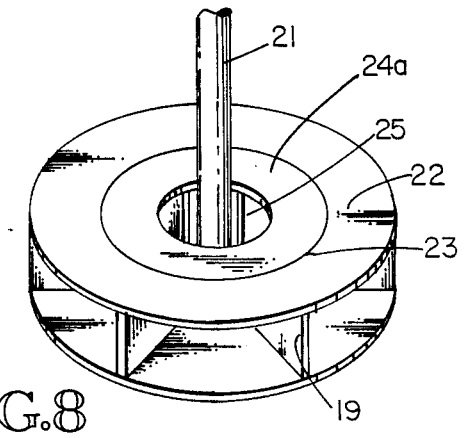
FIG. 8 is an isometric view of the mixing element of FIG. 2 including a second embodiment of the flow restrictor and top baffle plate in place.

FIG. 8 illustrates a second embodiment of the flow restrictor which may also be used on either the FIG. 1 or FIG. 2 embodiment of the mixing element. In the FIG. 8 embodiment, the washer shaped flow restrictor 24a has an enlarged central opening 25 and has its outside diameter chosen so as to conveniently fit within the opening 23 of the top baffle plate 22. As in the case of use of the flow restrictor 24, no modification of the mixing element is necessary in order to install the flow restrictor. In the FIG. 8 embodiment, the central opening 25 will be sized so as to permit a predetermined flow rate about the drive shaft 21. The flow restrictor 24a is supported vertically on the inner ends of the vanes 19 as described relative to the flow restrictor 24 and similarly is held in place by the downward flow of liquid impinging against the restrictor during operation. In some respects the flow restrictor 24a has advantages not present with the restrictor 24 since it is easier to install because of the larger central opening 25. It allows for liquid flow downwardly about the shaft 21 which is normally the main flow path of the liquid during rotation of the mixer.

Figure 3:
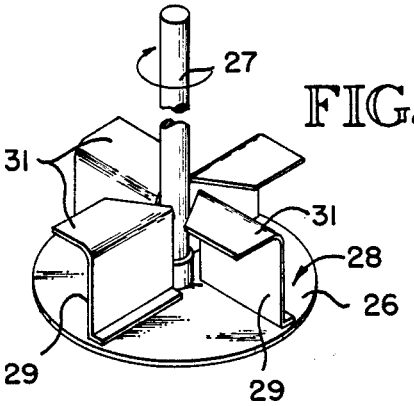
FIG. 3 is a third embodiment of the mixing element utilizing right angled protrusions on the mixing vanes in place of the top baffle plate.

FIG. 3 illustrates a third embodiment of the invention wherein the baffling action of the ring 6 as shown in FIG. 1, is performed by horizontally directed extensions of the mixing vanes. As seen in FIG. 3, the bottom disc 26 may be identical to the bottom discs 5 and 20 previously described for the FIGS. 1 and 2 embodiments and likewise, the drive shaft 27 and its connection to the disc 26 may be identical to that previously described. The mixing vanes 28 each have a vertical section 29 extending upwardly from the bottom disc 26 and may reach from the outer periphery of the disc 26 to a position adjacent the bottom end of the shaft 27 as previously described. Each vertical section 29 has a horizontal baffle 31. If the vanes are constructed from sheet metal, the horizontal baffle 31 may be a right angular portion bent over from the top part of the vane. The horizontal width of the baffle 31 may be varied depending upon the flow pattern desired. As in the case of the baffle plate 6 of FIG. 1, the baffles 31 prevent the liquid from rising vertically in the area of the vane and, as the shaft is rotated, cause the fluid to be driven in a radial or tangential direction away from the central shaft. This in turn causes a downward flow about the shaft 27 resulting in substantially the same fluid flow pattern shown in FIG. 5.

Figure 4:
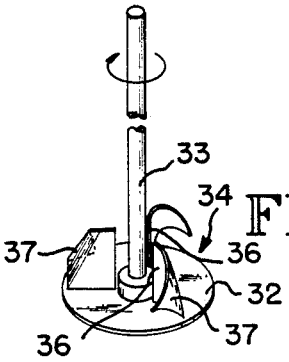
FIG. 4 is an isometric view of a fourth embodiment of the invention wherein curved sections of the mixing vanes perform the baffling function.

Still another embodiment of the invention is shown in FIG. 4 wherein the bottom plate 32 and shaft 33 are identical to the shaft and bottom plates previously described. The vanes 34 in this embodiment include vertical portions 36 secured to the bottom plate 32 and curved top edges 37 which are slanted downwardly and outwardly from the central shaft and curved smoothly into the vertical section 36. The action of the curved vanes when the shaft 33 is rotated in the direction of the arrow is substantially the same as that described for the FIG. 3 embodiment wherein liquid is prevented from rising in the general area adjacent the vane and is caused to flow horizontally and radially outwardly from the central shaft resulting in a downward flow of liquid about the shaft 33. The flow pattern of the liquid during mixing is substantially the same as that illustrated in FIG. 5 and previously described for the other embodiments.

Although the present invention has been described and illustrated with respect to specific embodiments thereof, it will be apparent to those skilled in the art that modifications may be made without departing from the spirit of the invention or from the scope of the appended claims.

What is claimed is:

1. A mixing device for mixing a body of liquid and dispersed solids confined in an open top consisting comprising in combination;

a rotatable mixing shaft, said shaft being substantially vertical and having a top and a bottom end for insertion into said container, a planar imperforated circular disc having top and bottom surfaces with the top surface thereof fixedly connected to the bottom end of said shaft at the center point of the disc for rotation therewith, said disc being normal to said shaft and having a substantially smooth circular unobstructed flat bottom surface, a plurality of vane means fixed to the top surface of said disc and spaced equidistantly about the circumference thereof for driving liquid in a lateral direction away from said mixing shaft upon rotation of the shaft in one direction, said vane means being located within the peripheral confines of said disc, and baffle means overlying each said vane means for preventing upward vertical flow in the area of said vanes so as to concentrate the flow of liquid laterally along said vanes, said baffle means being spaced radially outwardly from said shaft to provide a controlled flow passage for downward vertical flow of liquid as it is drawn downwardly by the lateral flow produced by said vanes, whereby liquid is caused to flow vertically downwardly along said shaft and then moved laterally along said vanes with great force upon rotation of said shaft in said one direction, said flat smooth bottom and the circular configuration of the disc permitting operation of the mixing device on the bottom surface and inside peripheral edge of the container without damage to the container walls.

2. The device of claim 1 wherein;

said baffle means comprises a ring shaped circular plate with a central opening therein defining said central flow passage to permit downward flow of liquid along said shaft during rotation of the shaft, said baffle plate being connected to the top surface of said vanes.

3. The device of claim 2 wherein;

each said vane means extends from the peripheral edge of the disc and has an inward end adjacent the bottom end of the shaft, and flow restrictor means removably engagable about said shaft and seated on the inward ends of said vanes for varying the effective area of said central flow passage.

4. The device according to claim 3 wherein;

said flow restrictor comprises a flat annular ring having a central opening with a diameter conforming to the diameter of said shaft so as to be easily engagable thereon and outside diameter less than the diameter of the central opening of said baffle plate, the annular space between the outside edge of said flow restrictor and the edge of the central opening in said baffle plate comprising said central flow passage.

5. The device according to claim 3 wherein;

said flow restrictor comprises a flat annular ring having an outside diameter conforming to the diameter of the central opening in said baffle plate so as to be easily received therein and a central opening with a diameter greater than the diameter of said shaft, the central opening in said flow restrictor defining said central flow passage.

6. The device according to claim 3 wherein;

said vanes extend from the peripheral edge of said disc in a direction tangential to a circle concentric with said shaft.

7. The device according to claim 3 wherein;

said vanes extend from the peripheral edge of said disc in a redial direction relative to said shaft.

8. The device according to claim 1 wherein;

said baffle means comprises a projection on the top portion of each said mixing vanes, said projection being positioned to restrict flow of fluid in an upward direction in the area of each said vanes.

9. The device according to claim 8 wherein;

each said vane comprises a vertical planar portion and an integral horizontal planar portion extending in the direction of rotation of said shaft during mixing.

10. The device according to claim 8 wherein; a horizontally curved integral portion extending in the direction of rotation of said shaft during mixing.

11. A mixing device for mixing a body of liquid and dispersed solids confined in an open top container comprising;

a substantially vertical power driven rotatable mixing shaft, said shaft having a top and a bottom end for insertion into said container, a planar imperforate circular disc having top and bottom surfaces with the top surface thereof fixedly connected to the bottom end of said shaft at the center point of the disc for rotation therewith, said disc being normal to the axis of said shaft and having a substantially flat smooth unobstructed bottom surface, a plurality of upstanding mixing vanes fixed to the top surface of said disc and spaced equidistantly about the circumference thereof, said vanes being located within the outer peripheral edge of said disc and extending inwardly with the inner ends located adjacent the bottom end of said shaft, the outer periphery of said disc being unobstructed, whereby upon rotation of said shaft in one direction, liquid is driven radially outwardly by said vanes, an annular baffle plate having substantially the same outside diameter as said disc and connected to the top edges of said upstanding mixing vanes and extending in a plane parallel to the plane of said disc, said baffle plate having a central opening defining a central vertical flow passage about said shaft, whereby said baffle prevents vertical flow in the area of said vanes and connections flow in a lateral direction along said vanes, fluid being drawn downwardly through said central flow passage by the lateral flow produced by said vanes, said mixing device and said container being freely movable relative to one another whereby said disc may be operated on the bottom of said container and moved about the inside periphery thereof for dislodging unmixed concentrations of solid particles without damaging the walls of said container, said vanes serving to impel fluid with great force outwardly against the sides of said container.

12. The device according to claim 11 wherein said mixing vanes extend radially inwardly beyond the edge of the central opening in said baffle plate, and a removable flow restrictor means comprising a flat annular ring engagable about said shaft and seated on the inward ends of said vanes for varying the effective area of said central flow passage.

13. The device according to claim 11 wherein said flow restrictor has a central opening with a diameter conforming to the diameter of said shaft so as to be easily engagable thereon and an outside diameter less than the diameter of the central opening of said baffle plate, the annular space between the outside edge of said flow restrictor and the edge of the central opening in said baffle plate comprising said central flow passage, said flow restrictor being supported on the inner ends of said vanes and held in place by the downward force of the liquid flow through the central flow passage.

14. The device according to claim 11, wherein said flow restrictor has an outside diameter conforming to the diameter of the central opening in said baffle plate so as to be easily received therein and a central opening with a diameter greater than the diameter of said shaft, the central opening in said flow restrictor defining said central flow passage, said flow restrictor being supported on the inner ends of said vanes and held in place by the downward force of the liquid flow through the central flow passage.

* * * * *

UNITED STATES PATENT AND TRADEMARK OFFICE

CERTIFICATE OF CORRECTION

PATENT NO. : 4,893,941

DATED : January 16,1990

INVENTOR(S) : Joseph M. Wayte

It is certified that error appears in the above-identified patent and that said Letters Patent is hereby corrected as shown below:

Col. 6, line 9
Claim 1, line 2, cancel "consisting" and insert --container-- after "top".
Col. 7, line 29
Claim 10, line 1, insert --each said vane comprises a vertical planar portion and-- after "wherein;".
Col. 8, line 12
Claim 11, line 33, cancel "connections" and insert --concentrates-- after "and".

Signed and Sealed this

Fifteenth Day of January, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,893,941

DATED : January 16, 1990

INVENTOR(S) : Joseph M. Wayte

It is certified that error appears in the above-identified patent and that said Letters Patent is hereby corrected as shown below:

Col. 8 , line 1, cancel "11" and insert --12-- after "claim".

Col. 8 , line 1, cancel "11" and insert --12-- after "claim".

Signed and Sealed this

Twenty-ninth Day of December, 1992

*Attest:*

DOUGLAS B. COMER

*Attesting Officer*

*Acting Commissioner of Patents and Trademarks*